US011402104B2

(12) United States Patent
Cadima

(10) Patent No.: US 11,402,104 B2
(45) Date of Patent: Aug. 2, 2022

(54) COIL HEATING ELEMENT WITH A HEAT TRANSFER DISK

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 338 days.

(21) Appl. No.: 16/574,196

(22) Filed: Sep. 18, 2019

(65) Prior Publication Data

US 2021/0080115 A1 Mar. 18, 2021

(51) Int. Cl.
*F24C 7/08* (2006.01)
*F24C 15/10* (2006.01)

(52) U.S. Cl.
CPC ..... *F24C 7/087* (2013.01); *F24C 15/105* (2013.01)

(58) Field of Classification Search
CPC ..... F24C 7/087; F24C 15/105; H05B 3/76; H05B 3/72
USPC ..... 219/447.1, 448.11, 448.14, 452.11
See application file for complete search history.

(56) References Cited

U.S. PATENT DOCUMENTS

| | | | | |
|---|---|---|---|---|
| 2,399,423 | A * | 4/1946 | Bletz | F24C 15/105 219/448.16 |
| 3,041,437 | A * | 6/1962 | Carissimi | H05B 1/0213 219/448.16 |
| 4,812,624 | A | 3/1989 | Kern | |
| 6,246,033 | B1 | 6/2001 | Shah | |
| 6,753,509 | B2 | 6/2004 | Gratz et al. | |
| 2008/0264926 | A1 | 10/2008 | Peng | |
| 2018/0238559 | A1 * | 8/2018 | Pasqual | H05B 3/76 |

FOREIGN PATENT DOCUMENTS

| | | | |
|---|---|---|---|
| CN | 201391917 | Y | 1/2010 |
| GB | 2414559 | B | 8/2007 |
| JP | 6017498 | B2 | 11/2016 |

* cited by examiner

*Primary Examiner* — Thien S Tran
(74) *Attorney, Agent, or Firm* — Dority & Manning, P.A.

(57) ABSTRACT

An electric resistance heating coil assembly includes a spiral wound sheathed heating element having a first coil section and a second coil section. A bimetallic thermostat is connected in series between the first and second coil sections of the spiral wound sheathed heating element. The bimetallic thermostat is spring loaded such that a distal end of the bimetallic thermostat is urged away from a top surface of the spiral wound sheathed heating element. A heat transfer disk is positioned on the bimetallic thermostat at the distal end of the bimetallic thermostat.

20 Claims, 4 Drawing Sheets

COIL HEATING ELEMENT WITH A HEAT TRANSFER DISK

FIELD OF THE INVENTION

The present subject matter relates generally to electric coil heating elements for appliances.

BACKGROUND OF THE INVENTION

Recent regulatory requirements mandate that electric coil heating elements on cooktop appliances be incapable of heating cooking oil to an oil ignition temperature. Thus, certain electric coil heating elements utilize a bimetallic thermostat to interrupt power to the coil when the thermostat reaches a tripping point. In some cooktops, the thermostat is remotely positioned from the cookware and infers the cookware temperature through correlation. In other cooktops, the thermostat contacts a bottom of the cookware to improve correlation. However, whether remotely positioned from the cookware or contacting the cookware, imperfect correlation requires conservative thermostat calibrations and thus results in reduced performance.

Known bimetallic thermostats have shortcomings. In particular, the flatness of the coil has a significant impact to system performance, as does the flatness of the bottom of the cookware. Poor contact between the cookware and the coil cause the portions of the coil that have poor conduction to the cookware to glow red hot and radiate heat. Radiative heat transfer from the coil to the thermostat can overcome the heat transfer from the cookware to the thermostat, causing the thermostat to trip early.

BRIEF DESCRIPTION OF THE INVENTION

Aspects and advantages of the invention will be set forth in part in the following description, or may be apparent from the description, or may be learned through practice of the invention.

In an example embodiment, an electric resistance heating coil assembly includes a spiral wound sheathed heating element having a first coil section and a second coil section. A bimetallic thermostat is connected in series between the first and second coil sections of the spiral wound sheathed heating element. The bimetallic thermostat is spring loaded such that a distal end of the bimetallic thermostat is urged away from a top surface of the spiral wound sheathed heating element. A heat transfer disk is positioned on the bimetallic thermostat at the distal end of the bimetallic thermostat. The heat transfer disk is positioned concentrically with a center of the spiral wound sheathed heating element. A diameter of the heat transfer disk is greater than a diameter of the bimetallic thermostat, and the diameter of the heat transfer disk is less than a diameter of the center of the spiral wound sheathed heating element.

In another example embodiment, an electric resistance heating coil assembly includes a spiral wound sheathed heating element having a first coil section and a second coil section. A bimetallic thermostat is connected in series between the first and second coil sections of the spiral wound sheathed heating element. The bimetallic thermostat spring loaded such that a distal end of the bimetallic thermostat is urged away from a top surface of the spiral wound sheathed heating element. A heat transfer disk is positioned on the bimetallic thermostat at the distal end of the bimetallic thermostat. The heat transfer disk positioned at a center of the spiral wound sheathed heating element. A ratio of a diameter of the heat transfer disk to a thickness of the heat transfer disk being no less than twenty and no greater than seventy-five.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
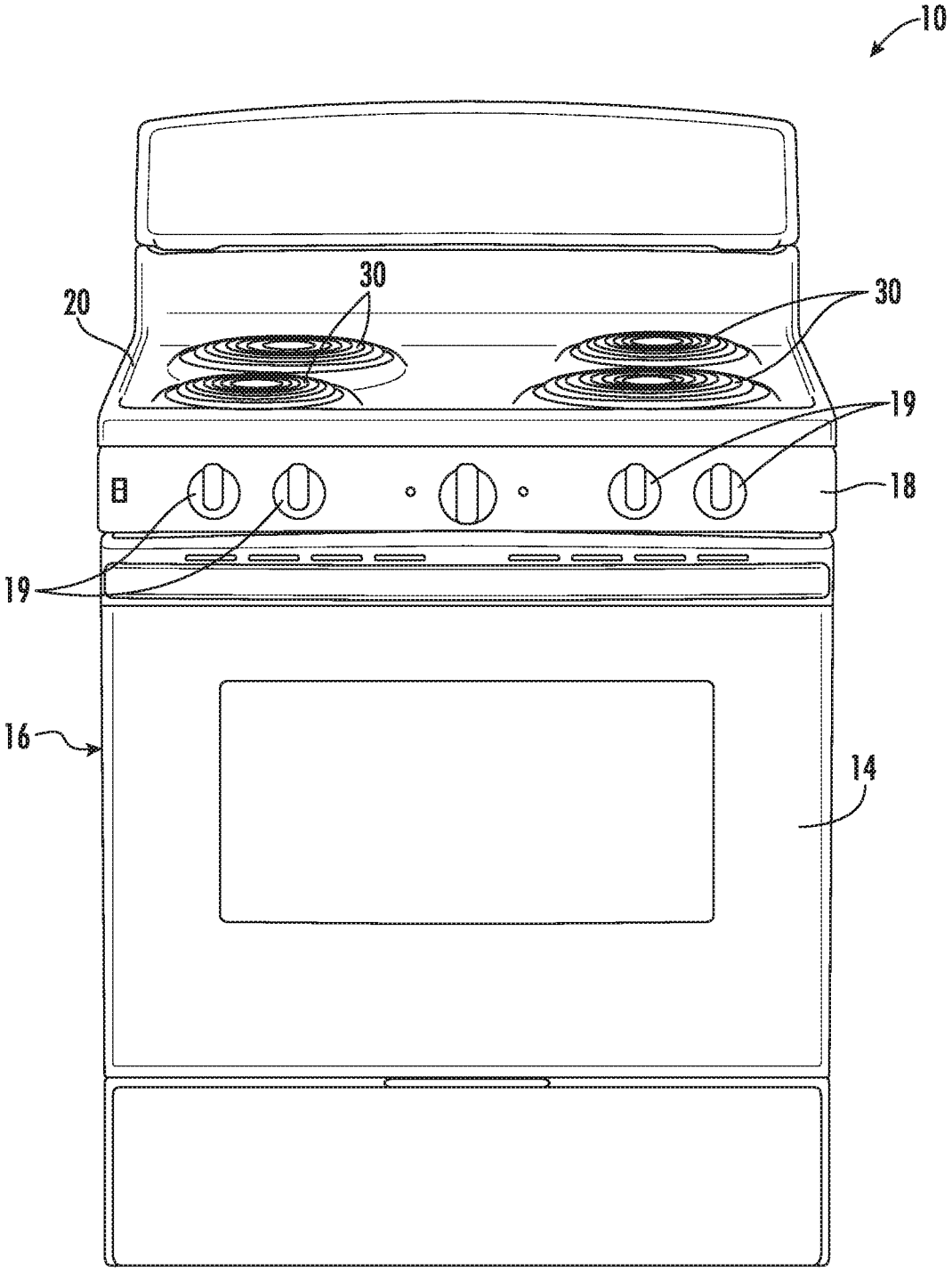
FIG. 1 is a front, perspective view of a range appliance according to an example embodiment.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front, perspective view of a range appliance 10 according to an example embodiment. Range appliance 10 is provided by way of example only and is not intended to limit the present subject matter to the particular arrangement shown in FIG. 1. Thus, e.g., the present subject matter may be used with other cooktop appliance configurations, e.g., double oven range appliances, standalone cooktop appliances, etc.

A top panel 20 of range appliance 10 includes heating elements 30. Heating elements 30 may be, e.g., electrical resistive heating elements. Range appliance 10 may include only one type of heating element 30, or range appliance 10 may include a combination of different types of heating elements 30, such as a combination of electrical resistive heating elements and gas burners. Further, heating elements 30 may have any suitable shape and size, and a combination of heating elements 30 of different shapes and sizes may be used.

A cooking utensil, such as a pot, pan, or the like, may be placed on heating elements 30 to cook or heat food items placed in the cooking utensil. Range appliance 10 also includes a door 14 that permits access to a cooking chamber 16 of range appliance 10, e.g., for cooking or baking of food items therein. A control panel 18 having controls 19 permits a user to make selections for cooking of food items; although shown on a front panel of range appliance 10, control panel 18 may be positioned in any suitable location. Controls 19 may include buttons, knobs, and the like, as well as combinations thereof. As an example, a user may manipulate one or more controls 19 to select a temperature and/or a heat or power output for each heating element 30.

Figure 2:
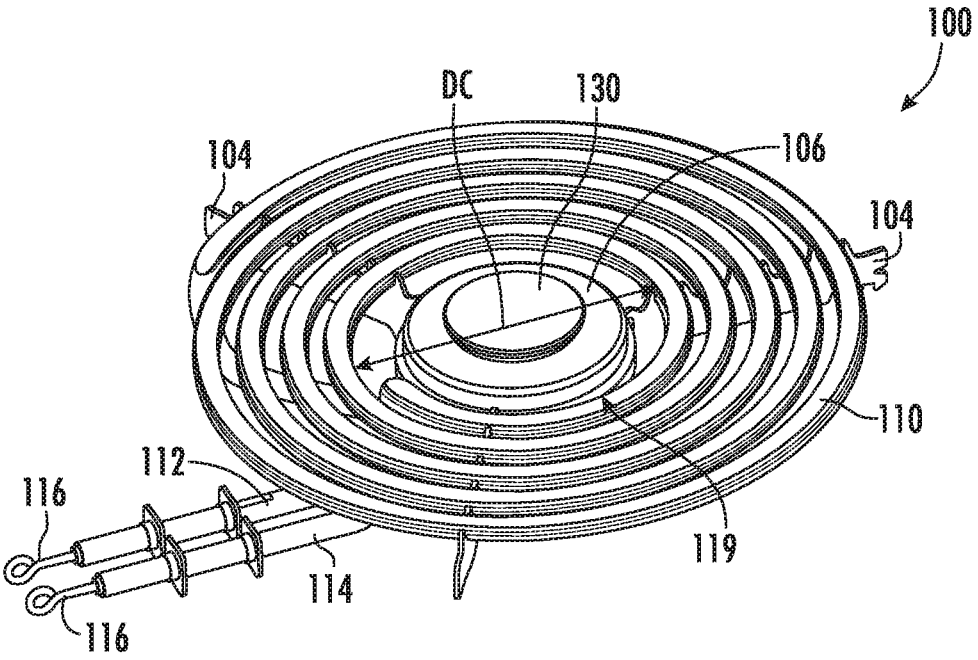
FIG. 2 is a top, perspective view of an electric resistance heating coil assembly of the example range appliance of FIG. 1.
Figure 3:
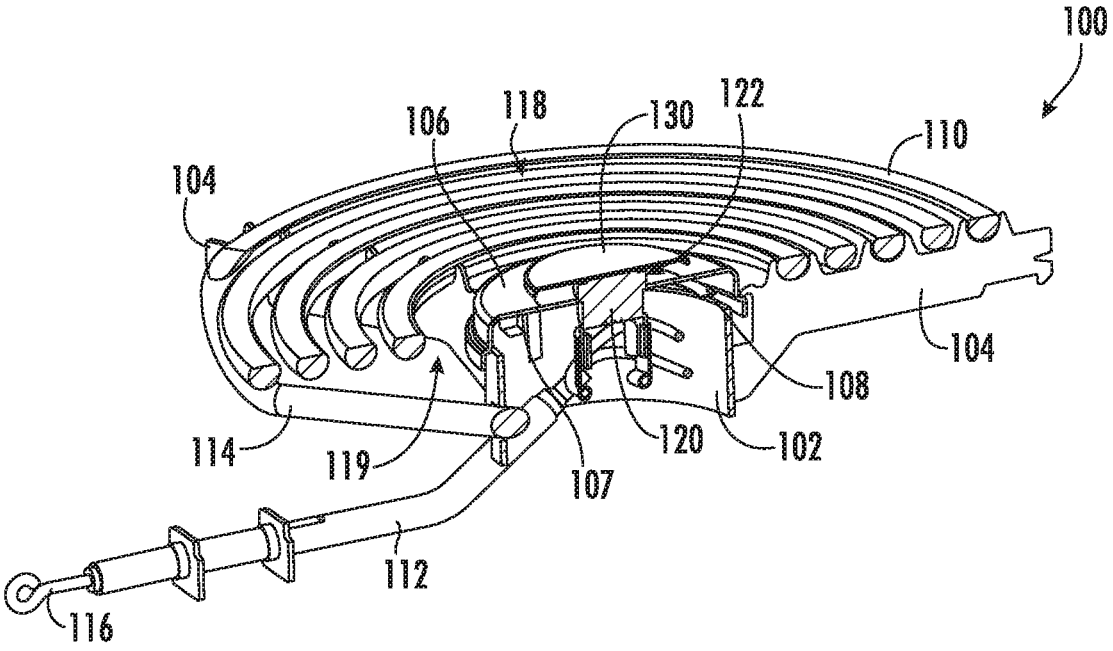
FIGS. 3 and 4 are section views of the electric resistance heating coil assembly of FIG. 2.
Figure 4:
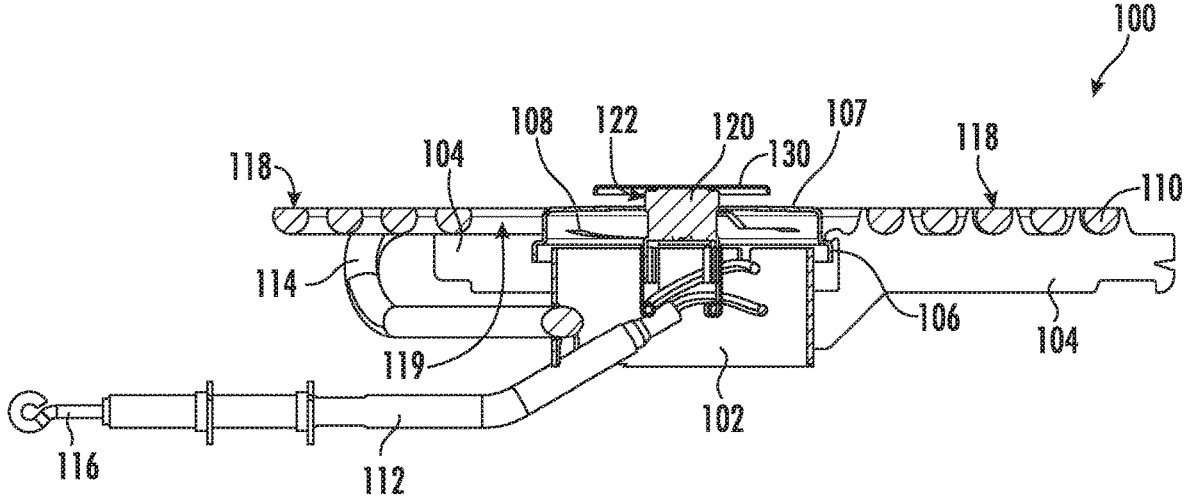

FIG. 2 is a top, perspective view of an electric resistance heating coil assembly 100 of range appliance 10. FIGS. 3 and 4 are section views of electric resistance heating coil assembly 100. Electric resistance heating coil assembly 100 may be used as one or more of heating elements 30 in range appliance 10. However, while described in greater detail below in the context of range appliance 10, it will be understood that electric resistance heating coil assembly 100 may be used in or with any suitable cooktop appliance in alternative example embodiments. As discussed in greater detail below, electric resistance heating coil assembly 100 includes features for facilitating conductive heat transfer between a bimetallic thermostat 120 and a utensil positioned on electric resistance heating coil assembly 100.

As shown in FIGS. 2 through 4, electric resistance heating coil assembly 100 includes a spiral wound sheathed heating element 110. Spiral wound sheathed heating element 110 has a first coil section 112 and a second coil section 114. Spiral wound sheathed heating element 110 also has a pair of terminals 116. Each of first and second coil sections 112, 114 is directly coupled or connected to a respective terminal 116. A voltage differential across terminals 116 induces an electrical current through spiral wound sheathed heating element 110, and spiral wound sheathed heating element 110 may increase in temperature by resisting the electrical current through spiral wound sheathed heating element 110.

Bimetallic thermostat 120 is connected in series between first and second coil sections 112, 114 of spiral wound sheathed heating element 110. Bimetallic thermostat 120 opens and closes in response to a temperature of bimetallic thermostat 120. For example, bimetallic thermostat 120 may be spring loaded such that a distal end 122 of bimetallic thermostat 120 is urged away from a top surface 118 of spiral wound sheathed heating element 110. Thus, distal end 122 of bimetallic thermostat 120 may be urged towards a utensil (not shown) positioned on top surface 118 of spiral wound sheathed heating element 110. Bimetallic thermostat 120 may measure the temperature of the utensil on top surface 118 of spiral wound sheathed heating element 110 due to heat transfer between the utensil and bimetallic thermostat 120. As discussed in greater detail below, electric resistance heating coil assembly 100 includes features for facilitating conductive heat transfer between the utensil on top surface 118 of spiral wound sheathed heating element 110 and bimetallic thermostat 120.

Electric resistance heating coil assembly 100 may also include a shroud 102 and coil support arms 104. Coil support arms 104 extend, e.g., radially, from shroud 102, and spiral wound sheathed heating element 110 is positioned on and supported by coil support arms 104. Coil support arms 104 may rest on top panel 20 to support electric resistance heating coil assembly 100 on top panel 20. Bimetallic thermostat 120 may be mounted to a shroud cover 106, e.g., on a top wall 107 of shroud cover 106. Shroud cover 106 extends over shroud 102. In particular, a top of shroud 102 may be nested in shroud cover 106. A spring 108 biases shroud cover 106 and bimetallic thermostat 120 thereon upwardly.

As shown in FIGS. 2 through 4, electric resistance heating coil assembly 100 includes a heat transfer disk 130. Heat transfer disk 130 is positioned on bimetallic thermostat 120 at distal end 122 of bimetallic thermostat 120. For example, heat transfer disk 130 may contact distal end 122 of bimetallic thermostat 120. Thus, heat transfer disk 130 may be in direct thermal conductive communication with bimetallic thermostat 120. Because heat transfer disk 130 is positioned at distal end 122 of bimetallic thermostat 120, heat transfer disk 130 may also be urged away from top surface 118 of spiral wound sheathed heating element 110. In particular, heat transfer disk 130 may be urged against the utensil on top surface 118 of spiral wound sheathed heating element 110 due to the spring loading of bimetallic thermostat 120.

Heat transfer disk 130 may be formed of aluminum, copper, a copper alloy, or an aluminum alloy. Such materials advantageously facilitate conductive heat transfer between the utensil on top surface 118 of spiral wound sheathed heating element 110 and heat transfer disk 130. In certain example embodiments, a casing 124 (FIG. 5) of bimetallic thermostat 120 and heat transfer disk 130 may be formed from a common material, such as one of aluminum, copper, a copper alloy, or an aluminum alloy, in order to advantageously facilitate conductive heat transfer between casing 124 and heat transfer disk 130.

Heat transfer disk 130 and/or bimetallic thermostat 120 may be positioned concentrically with a center 119 of spiral wound sheathed heating element 110. Center 119 of spiral wound sheathed heating element 110 may be open, and spiral wound sheathed heating element may extend circumferentially around heat transfer disk 130 and/or bimetallic thermostat 120 at center 119. Heat transfer disk 130 may also cover distal end 122 of bimetallic thermostat 120. Thus, heat transfer disk 130 may be positioned between bimetallic thermostat 120 and a utensil on top surface 118 of spiral wound sheathed heating element 110, and heat transfer disk 130 may contact the utensil. Heat transfer disk 130 may also include a flange 132 that extends downwardly towards shroud cover 106 towards shroud cover 106.

Figure 5:
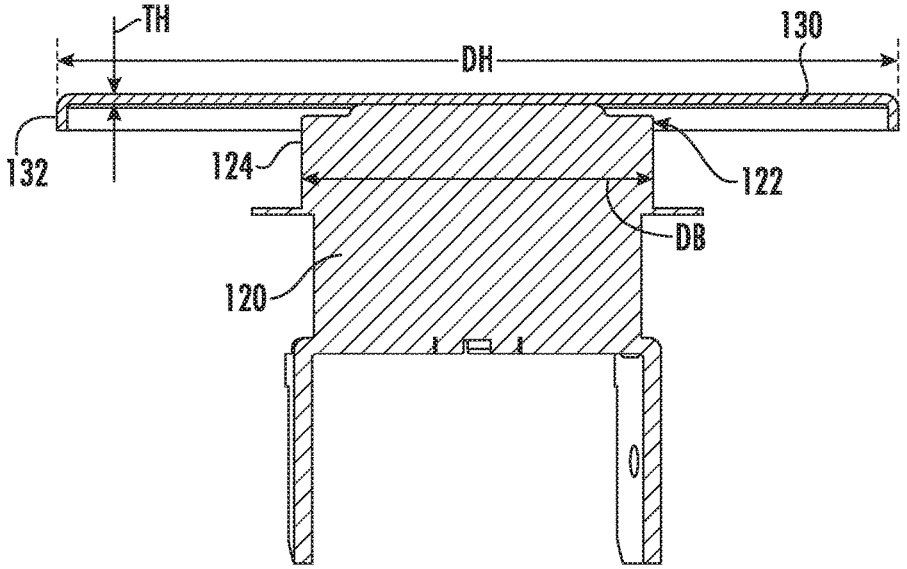
FIG. 5 is a section view of a heat transfer disk and a bimetallic thermostat of the electric resistance heating coil assembly of FIG. 2.

FIG. 5 is a section view of heat transfer disk 130 and bimetallic thermostat 120. As discussed in greater detail below, heat transfer disk 130 may be sized to facilitate conductive heat transfer between a utensil on top surface 118 of spiral wound sheathed heating element 110 and bimetallic thermostat 120. For example, a diameter DH of heat transfer disk 130 may be no less than two times greater than a diameter DB of bimetallic thermostat 120, e.g., in a plane that is perpendicular to vertical. In addition, the diameter DH of heat transfer disk 130 may be less than a diameter DC (FIG. 2) of center 119 of spiral wound sheathed heating element 110. As may be seen from the above, the diameter DH of heat transfer disk 130 may be significantly greater than the diameter DB of bimetallic thermostat 120. Such sizing of heat transfer disk 130 relative to bimetallic thermostat 120 advantageously assists conductive heat transfer from the utensil on top surface 118 of spiral wound sheathed heating element 110 to bimetallic thermostat 120.

In certain example embodiments, the diameter DH of heat transfer disk 130 may be no less than one inch (1") and no greater than one and a half inches (1.5"). Conversely, a thickness TH of heat transfer disk 130, e.g., that is perpendicular to the diameter DH of heat transfer disk 130, may be no less than two hundredths of an inch (0.02") and no greater than five hundredths of an inch (0.05"). In addition, a ratio of the diameter DH of heat transfer disk 130 to the thickness TH of heat transfer disk 130 may be no less than twenty (20) and no greater than seventy-five (75) Such sizing of heat transfer disk 130 advantageously assists conductive heat transfer from the utensil on top surface 118 of spiral wound sheathed heating element 110 to bimetallic thermostat 120.

Figure 6:
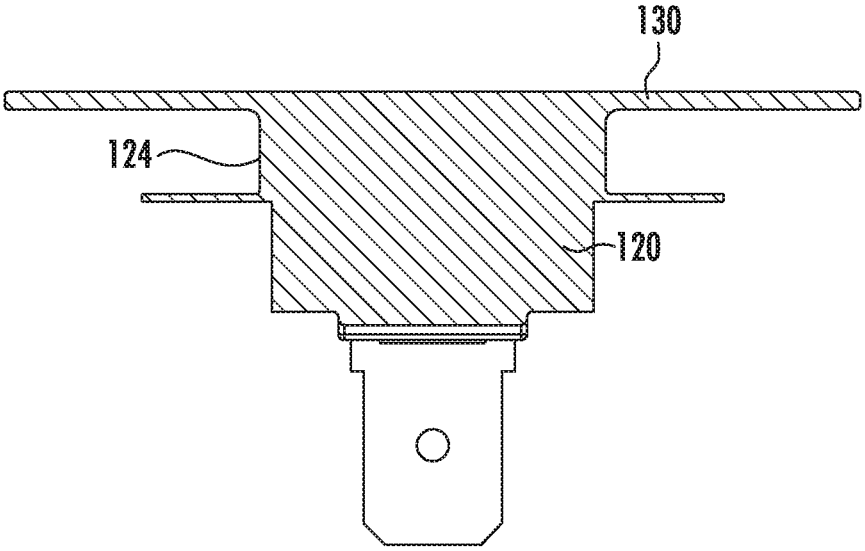
FIG. 6 is a section view of a heat transfer disk and a bimetallic thermostat according to another example embodiment.
Figure 7:
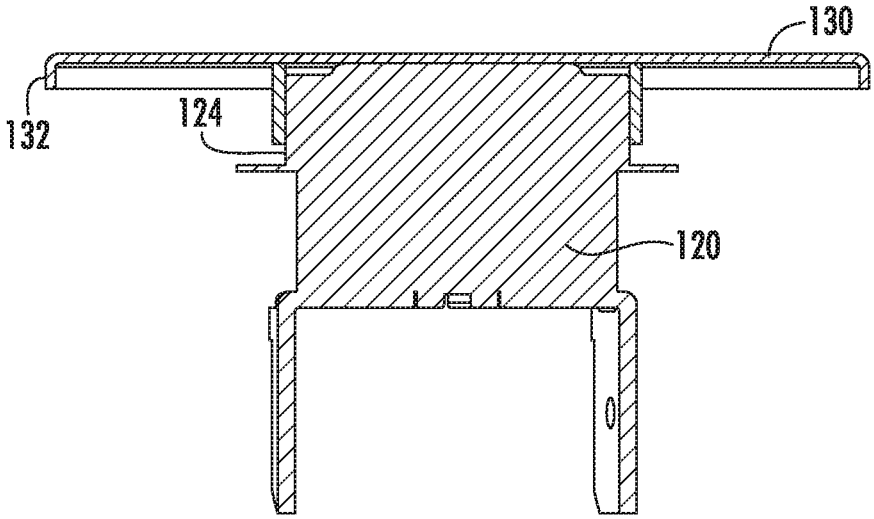
FIG. 7 is a section view of a heat transfer disk and a bimetallic thermostat according to yet another example embodiment.

As noted above, heat transfer disk 130 may be in direct thermal conductive communication with bimetallic thermostat 120. To provide direct thermal conductive communication between bimetallic thermostat 120 and heat transfer disk 130, heat transfer disk 130 may be spot welded, seam welded, ultrasonic welded or resistance welded to bimetallic thermostat 120. It will be understood that other connections between bimetallic thermostat 120 and heat transfer disk 130 also provide direct thermal conductive communication. For example, with reference to FIG. 6, heat transfer disk 130 may be integrally formed with casing 124 of bimetallic thermostat 120. Thus, casing 124 of bimetallic thermostat 120 and heat transfer disk 130 may be formed from a single, continuous piece of material, such as aluminum, copper, a copper alloy, or an aluminum alloy. As another example, with reference to FIG. 7, heat transfer disk 130 may be crimped or pressed onto bimetallic thermostat 120.

As may be seen from the above, heat transfer disk 130 advantageously has increased conductive heat transfer from a utensil on top surface 118 of spiral wound sheathed heating element 110 to bimetallic thermostat 120 relative to known heating elements without heat transfer disk 130. Known heating elements without heat transfer disk 130 have limited ability to transfer heat between a cooking utensil and an associated bimetallic thermostat due to limited contact area between such components, along with varying degrees of contact resistance between the cooking utensil and bimetallic thermostat. Testing has shown that heat transfer disk 130 mounted to bimetallic thermostat 120 at distal end 122 of bimetallic thermostat 120 increases conduction between bimetallic thermostat 120 and cookware on spiral wound sheathed heating element 110. Even under conditions that cause known heating elements to trip before water can boil, electric resistance heating coil assembly 100 runs continuously and without interrupted power. Thus, electric resistance heating coil assembly 100 is advantageously robust to warped coils and bowed bottom pans, and better tracks the temperature of cookware despite excessive heat transfer from spiral wound sheathed heating element 110.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electric resistance heating coil assembly, comprising:

a spiral wound sheathed heating element having a first coil section and a second coil section;

a bimetallic thermostat connected in series between the first and second coil sections of the spiral wound sheathed heating element, the bimetallic thermostat spring loaded such that a distal end of the bimetallic thermostat is urged away from a top surface of the spiral wound sheathed heating element;

a shroud;

a plurality of coil support arms extending from the shroud, the spiral wound sheathed heating element positioned on and supported by the plurality of coil support arms;

a shroud cover defining a central opening at a top wall of the shroud cover, the bimetallic thermostat mounted to the shroud cover the central opening of the shroud cover, a top of the shroud nested in the shroud cover; and a heat transfer disk positioned on the bimetallic thermostat at the distal end of the bimetallic thermostat, the heat transfer disk positioned concentrically with a center of the spiral wound sheathed heating element, the heat transfer disk positioned above the shroud cover, wherein a diameter of the heat transfer disk is greater than a diameter of the bimetallic thermostat, and the diameter of the heat transfer disk is less than a diameter of the center of the spiral wound sheathed heating element.

2. The electric resistance heating coil assembly of claim 1, wherein the diameter of the heat transfer disk is no less than two times greater than the diameter of the bimetallic thermostat, and the heat transfer disk is in direct thermal conductive communication with the bimetallic thermostat.

3. The electric resistance heating coil assembly of claim 2, wherein the heat transfer disk is spot welded, seam welded, ultrasonic welded, or resistance welded to the bimetallic thermostat.

4. The electric resistance heating coil assembly of claim 2, wherein the heat transfer disk is crimped or pressed onto the bimetallic thermostat.

5. The electric resistance heating coil assembly of claim 1, wherein the diameter of the heat transfer disk is no less than two times greater than the diameter of the bimetallic thermostat, and the heat transfer disk is integrally formed with a casing of the bimetallic thermostat.

6. The electric resistance heating coil assembly of claim 1, wherein the heat transfer disk is formed of aluminum, copper, a copper alloy, or an aluminum alloy.

7. The electric resistance heating coil assembly of claim 1, wherein the heat transfer disk covers the distal end of the bimetallic thermostat.

8. The electric resistance heating coil assembly of claim 1, wherein a diameter of the heat transfer disk is no less than one inch and no greater than one and a half inches.

9. The electric resistance heating coil assembly of claim 1, wherein a thickness of the heat transfer disk is no less than two hundredths of an inch and no greater than five hundredths of an inch.

10. The electric resistance heating coil assembly of claim 1, wherein a ratio of a diameter of the heat transfer disk to a thickness of the heat transfer disk is no less than twenty and no greater than seventy-five.

11. An electric resistance heating coil assembly, comprising:

a spiral wound sheathed heating element having a first coil section and a second coil section;

a shroud;

a plurality of coil support arms extending from the shroud, the spiral wound sheathed heating element positioned on and supported by the plurality of coil support arms;

a shroud cover defining a central opening at a top wall of the shroud cover, the bimetallic thermostat mounted to the shroud cover the central opening of the shroud cover, a top of the shroud nested in the shroud cover;

a bimetallic thermostat connected in series between the first and second coil sections of the spiral wound sheathed heating element, the bimetallic thermostat spring loaded such that a distal end of the bimetallic thermostat is urged away from a top surface of the spiral wound sheathed heating element; and a heat transfer disk positioned on the bimetallic thermostat at the distal end of the bimetallic thermostat, the heat transfer disk positioned at a center of the spiral wound sheathed heating element, a ratio of a diameter of the heat transfer disk to a thickness of the heat transfer disk being no less than twenty and no greater than seventy-five, and wherein a flange of the heat transfer disk extends downwardly towards the shroud cover.

12. The electric resistance heating coil assembly of claim 11, wherein the diameter of the heat transfer disk is no less than one inch and no greater than one and a half inches.

13. The electric resistance heating coil assembly of claim 11, wherein the thickness of the heat transfer disk is no less than two hundredths of an inch and no greater than five hundredths of an inch.

14. The electric resistance heating coil assembly of claim 11, wherein the heat transfer disk is in direct thermal conductive communication with the bimetallic thermostat.

15. The electric resistance heating coil assembly of claim 14, wherein the heat transfer disk is spot welded, seam welded, ultrasonic welded, or resistance welded to the bimetallic thermostat.

16. The electric resistance heating coil assembly of claim 14, wherein the heat transfer disk is crimped or pressed onto the bimetallic thermostat.

17. The electric resistance heating coil assembly of claim 11, wherein the heat transfer disk is integrally formed with a casing of the bimetallic thermostat.

18. The electric resistance heating coil assembly of claim 11, wherein the heat transfer disk is formed of aluminum, copper, a copper alloy, or an aluminum alloy.

19. The electric resistance heating coil assembly of claim 11, wherein the heat transfer disk is positioned concentrically with the center of the spiral wound sheathed heating element.

20. The electric resistance heating coil assembly of claim 11, wherein the heat transfer disk covers the distal end of the bimetallic thermostat.

* * * * *